United States Patent [19]

Magid et al.

[11] Patent Number: 4,947,881

[45] Date of Patent: Aug. 14, 1990

[54] METHOD OF CLEANING USING HYDROCHLOROFLUOROCARBONS

[75] Inventors: Hillel Magid, Williamsville; Richard E. Eibeck, Orchard Park; Michael Van Der Puy, Cheektowaga; Chien C. Li, East Aurora, all of N.Y.

[73] Assignee: Allied-Signal Inc., Morris Township, Morris County, N.J.

[21] Appl. No.: 315,069

[22] Filed: Feb. 24, 1989

[51] Int. Cl.[5] ..... C23G 5/028; B08B 3/08

[52] U.S. Cl. ..... 134/40; 8/142

[58] Field of Search ..... 134/22.14, 22.19, 40; 252/364; 570/134

[56] References Cited

U.S. PATENT DOCUMENTS

| | | | |
|---|---|---|---|
| 2,413,696 | 1/1947 | Downing | 570/134 |
| 2,690,764 | 12/1949 | Benning | 570/134 |
| 2,838,457 | 6/1958 | Ballentine | 252/78 |
| 3,085,918 | 4/1963 | Sherliker | 134/30 |
| 4,465,609 | 8/1984 | Denis | 252/67 |

FOREIGN PATENT DOCUMENTS

| | | | |
|---|---|---|---|
| 0642285 | 1/1979 | U.S.S.R. | 570/134 |
| 1562026 | 3/1980 | United Kingdom . | |

OTHER PUBLICATIONS

Research Disclosure 14623 (Jun. 1978).

EPA "Findings of the Chlorofluorocarbon Chemical Substitutes International Committee", EPA-600/9-8-8-009 (Apr. 1988).

Kyodo News Service, Tokyo, Japan (Feb. 1989).

*Primary Examiner*—Asok Pal

*Assistant Examiner*—Ourmazd S. Ojan

*Attorney, Agent, or Firm*—Melanie L. Brown; Jay P. Friedenson

[57] ABSTRACT

A method of cleaning a surface of a substrate is provided. The method comprises treating the surface with a solvent comprising a compound of the formula $$CH_aCl_bF_c(CF_2)_dCH_eCl_fF_g$$

wherein a+e ranges from 1 to 4, b+f equals 2, c+g ranges from 0 to 3, d is from 1 to 4, a+b+c=3, and e+f+g−3.

21 Claims, No Drawings

METHOD OF CLEANING USING HYDROCHLOROFLUOROCARBONS

BACKGROUND OF THE INVENTION

The present invention relates to a method of cleaning a surface of a substrate using hydrochlorofluorocarbons as solvents.

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the act. For example, Sherliker et al. in U.S. Pat. No. 3,085,918 disclose such suitable vapor degreasers comprising a boiling sump, a clean sump, a water separator, and other ancilliary equipment.

Cold cleaning is another application where a number of solvents are used. In most cold cleaning applications, the soiled part is either immersed in the fluid or wiped with rags or similar objects soaked in solvents.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like. Trichlorotrifluoroethane has two isomers: 1,1,2-trichloro-1,2,2-trifluoroethane (known in the art as CFC-113) and 1,1,1-trichloro-2,2,2-trifluoroethane (known in the art as CFC-113a).

Chlorofluorocarbons (CFC) such as 113 are suspected of causing environmental problems in connection with the ozone layer. In Aug. 1988, the U.S. Environmental Protection Agency issued its final rules ordering a freeze on CFC production including CFC-113 at 1986 levels by mid-1989. Additional 20% and 50% cuts in CFC production are scheduled for 1993 and 1998.

In response to the need for stratospherically safe materials, substitutes have been developed and continue to be developed. *Research Disclosure* 14623 (June 1978) reports that 1,1-dichloro-2,2,2-trifluoroethane (known in the art as HCFC-123) is a useful solvent for degreasing and defluxing substrates. U.S. Pat. No. 4,465,609 teaches that HCFC-123 is useful as a heat transfer fluid in heat pumps and thermal engines. In the EPA "Findings of the Chlorofluorocarbon Chemical Substitutes International Committee", EPA No. 600/9-88-009 (Apr. 1988), it was reported on pages C-22 and C-23 that HCFC-123 and 1-fluoro-1,1-dichloroethane (known in the art as HCFC-141b) have potential as replacements for CFC-113 as cleaning agents.

A wide variety of consumer parts is produced on an annual basis in the United States and abroad. Many of these parts have to be cleaned during various manufacturing stages in order to remove undesirable contaminants. These parts are produced in tremendous quantities and as a result, substantial quantities of solvents are used to clean them. It is apparent that the solvent used must be compatible with the material to be cleaned.

During our analysis of the use of HCFC-123, HCFC-123a, and HCFC-141b as replacements for CFC-113, we discovered that upon the application of the aforementioned solvents to certain substrates, the HCFC-123, HCFC-123a, and HCFC-141b attacked the substrates so as to render the substrates useless for their intended application. Details of these experiments are set forth more fully below.

It is an object of the invention to provide a novel class of solvents for cleaning substrates.

It is another object of the invention to provide such a novel class of solvents which are stratospherically safe.

Yet another object of the invention is to provide such solvents which do not detrimentally attack a variety of substrates which are used in various industrial processes.

SUMMARY OF THE INVENTION

The objects of the invention are achieved by treating the surface with a solvent comprising a compound of the formula $$CH_aCl_bF_c(CF_2)_dCH_eCl_fF_g$$

wherein a+e ranges from 1 to 4, b+f equals 2, c+g ranges from 0 to 3, d is from 1 to 4, a+b+c−3, and $e+f+g=3$.

Kyodo News Service, Tokyo, Japan reported on Feb. 6, 1989 that HCFC-225CA and HCFC-225CB have the properties of CFC-113 as a cleaning agent.

The previously cited EPA paper lists 1,1-dichloro-2,2,3,3,3-pentafluoropropane on page C-37, line 5 as a potential CFC substitute but reports that a significant amount of developmental work is needed in toxicological testing, physical property measurements, and applications testing for such potential substitutes. The paper does not teach that 1,1-dichloro-2,2,3,3,3-pentafluoropropane is useful as a solvent. British Patent No. 1,562,026 teaches that 1,1-dichloro-2,2,3,3,3-pentafluoropropane is useful as a blowing agent but the reference does not teach that 1,1-dichloro-2,2,3,3,3-pentafluoropropane is useful as a solvent. U.S. Pat. No. 2,838,457 teaches that dichlorotrifluoropropane is a useful additive for hydraulic oil.

In addition to their usefulness in cleaning applications, the present solvents are advantageous because they have a low ozone depletion potential.

The present solvents may be used in liquid form in many applications where HCFC-123, HCFC-123a and HCFC-141b would be in vapor form. As a result, the present solvents are easier to contain and minimize solvent losses.

As such, the present invention responds to the need for stratospherically safe solvents for use in cleaning substrates wherein the substrate is not detrimentally attacked by the solvent.

Other advantages of the present invention will become apparent from the following description and appended claims.

DETAILED DESCRIPTION OF THE PREFERRED EMBODIMENTS

The solvents used comprise a compound of the formula $$CH_aCl_bF_c(CF_2)_dCH_eCl_fF_g$$

wherein a+e ranges from 1 to 4, b+f equals 2, c+g ranges from 0 to 3, d is from 1 to 4, a+b+c−3, and $e+f+g=3$.

Illustrative examples of useful solvents include 1,3-dichloro-2,2-difluoropropane; 1,3-dichloro-1,2,2-trifluoropropane; 1,3-dichloro-1,1,2,2-tetrafluoropropane; 1,3-dichloro-1,2,2,3-tetrafluoropropane; 1,3-dichloro-1,1,2,2,3-pentafluoropropane; 1,1-dichloro-2,2-difluoropropane; 1,1-dichloro-2,2,3-trifluoropropane; 1,1-dichloro-2,2,3,3-tetrafluoropropane; 1,1-dichloro-2,2,3,3,3-pentafluoropropane; 1,1-dichloro-1,2,2-trifluoropropane; 1,1-dichloro-1,2,2,3-tetrafluoropropane; and 1,1-dichloro-1,2,2,3,3-pentafluoropropane.

Other examples of useful solvents include 1,4-dichloro-2,2,3,3-tetrafluorobutane; 1,4-dichloro-1,2,2,3,3-pentafluorobutane; 1,4-dichloro-1,1,2,2,3,3-hexafluorobutane; 1,4-dichloro-1,2,2,3,3,4-hexafluorobutane; 1,4-dichloro-1,1,2,2,3,3,4-heptafluorobutane; 1,1-dichloro-2,2,3,3-tetrafluorobutane; 1,1-dichloro-2,2,3,3,4-pentafluorobutane; 1,1-dichloro-2,2,3,3,4,4-hexafluorobutane; 1,1-dichloro-2,2,3,3,4,4,4-heptafluorobutane; 1,1-dichloro-1,2,2,3,3-pentafluorobutane; 1,1-dichloro-1,2,2,3,3,4-hexafluorobutane; and 1,1-dichloro-1,2,2,3,3,4,4-heptafluorobutane.

Further examples of useful solvents include 1,5-dichloro-2,2,3,3,4,4-hexafluoropentane; 1,5-dichloro-1,2,2,3,3,4,4-heptafluoropentane; 1,5-dichloro-1,1,2,2,3,3,4,4-octafluoropentane; 1,5-dichloro-1,2,2,3,3,4,4,5-octafluoropentane; 1,5-dichloro-1,1,2,2,3,3,4,4,5-nonafluoropentane; 1,1-dichloro-2,2,3,3,4,4-hexafluoropentane; 1,1-dichloro-2,2,3,3,4,4,5-heptafluoropentane; 1,1-dichloro-2,2,3,3,4,4,5,5-octafluoropentane; 1,1-dichloro-2,2,3,3,4,4,5,5,5-nonafluoropentane; 1,1-dichloro-1,2,2,3,3,4,4-heptafluoropentane; 1,1-dichloro-1,2,2,3,3,4,4,5-octafluoropentane; and 1,1-dichloro-1,2,2,3,3,4,4,5,5-nonafluoropentane.

Additional examples of useful solvents include 1,6-dichloro-2,2,3,3,4,4,5,5-octafluorohexane; 1,6-dichloro-1,2,2,3,3,4,4,5,5-nonafluorohexane; 1,6-dichloro-1,1,2,2,3,3,4,4,5,5-decafluorohexane; 1,6-dichloro-1,2,2,3,3,4,4,5,5,6-decafluorohexane; 1,6-dichloro-1,1,2,2,3,3,4,4,5,5,6-undecafluorohexane; 1,1-dichloro-2,2,3,3,4,4,5,5-octafluorohexane; 1,1-dichloro-2,2,3,3,4,4,5,5,6-nonafluorohexane; 1,1-dichloro-2,2,3,3,4,4,5,5,6,6-decafluorohexane; 1,1-dichloro-2,2,3,3,4,4,5,5,6,6,6-undecafluorohexane; 1,1-dichloro-1,2,2,3,3,4,4,5,5-nonafluorohexane; 1,1-dichloro-1,2,2,3,3,4,4,5,5,6-decafluorohexane; and 1,1-dichloro-1,2,2,3,3,4,4,5,5,6,6-undecafluorohexane.

The preferred solvents are the aforementioned pentanes, butanes, and propanes. In a more preferred embodiment, the solvents are 1,1-dichloro-2,2,3,3,3-pentafluoropropane and 1,3-dichloro-1,1,2,2,3-pentafluoropropane. In another more preferred embodiment, the solvents are the pentanes, butanes, and propanes wherein c+g ranges from 0 to 2; the most preferred solvent is 1,1-dichloro-1,2,2-trifluoropropane.

These solvents are readily prepared from commercially available materials by standard and well-known organic syntheses techniques. For example, to prepare 1,1-dichloro-2,2,3,3,3-pentafluoropropane, 2,2,3,3,3-pentafluoro-1-propanol and p-toluenesulfonate chloride are reacted together to form 2,2,3,3,3-pentafluoropropyl-p-toluenesulfonate. Then, N-methylpyrrolidone, lithium chloride, and the 2,2,3,3,3-pentafluoropropyl-p-toluenesulfonate are reacted together to form 1-chloro-2,2,3,3,3-pentafluoropropane. Chlorine and the 1-chloro-2,2,3,3,3-pentafluoropropane are then reacted together to form 1,1-dichloro-2,2,3,3,3-pentafluoropropane.

For example, to prepare 1,3-dichloro-1,1,2,2,3-pentafluoropropane, 2,2,3,3-tetrafluoropropanol, tosyl chloride, and water are reacted together to form 2,2,3,3-tetrafluoropropyl p-toluenesulfonate. Then, N-methylpyrrolidone, potassium fluoride, and the 2,2,3,3-tetrafluoropropyl p-toluenesulfonate are reacted together to form 1,1,2,2,3-pentafluoropropane. Then, chlorine and the 1,1,2,2,3-pentafluoropropane are reacted to form 1,1,3-trichloro-1,2,2,3,3-pentafluoropropane. Finally, isopropanol and the 1,1,3-trichloro-1,2,2,3,3-pentafluoropropane are reacted to form 1,3-dichloro-1,1,2,2,3-pentafluoropropane.

For example, to prepare 1,1-dichloro-1,2,2-trifluoropropane, antimony trifluoride, bromine, and 2,2-dichloropropane are reacted together to form 2,2-difluoropropane. Then, chlorine and the 2,2-difluoropropane are reacted to form 1,1,1-trichloro-2,2-difluoropropane. Finally, antimony trifluoride, chlorine, and the 1,1,1-trichloro-2,2-difluoropropane are reacted to form 1,1-dichloro-1,2,2-trifluoropropane.

For example, to prepare 1,1-dichloro-2,2,3,3,4,4,4-heptafluorobutane, 2,2,3,3,4,4,4-heptafluorobutanol and p-toluenesulfonyl chloride are reacted to form 2,2,3,3,4,4,4-heptafluorobutyl-p-toluenesulfonate. Then, N-methylpyrrolidone, lithium chloride, and the 2,2,3,3,4,4,4-heptafluorobutyl-p-toluenesulfonate are reacted to form 1-chloro-2,2,3,3,4,4,4-heptafluorobutane. Finally, chlorine and the 1-chloro-2,2,3,3,4,4,4-heptafluorobutane are reacted to form the 1,1-dichloro-2,2,3,3,4,4,4-heptafluorobutane.

For example, to prepare 1,5-dichloro-1,1,2,2,3,3,4,4,5-nonafluoropentane, the process for the preparation of 1,3-dichloro-1,1,2,2,3-pentafluoropropane set forth above is followed except that octafluoropentanol is used as the starting material.

For example, to prepare 1,1-dichloro-2,2,3,3,4,4,5,5,6,6,6-undecafluorohexane, $CF_3(CF_2)_4CH_2OH$ is prepared by $NaBH_4$ or $LiAlH_4$ reduction of $CF_3(CF_2)_4COOEt$ or by reduction of $CF_3(CF_2)_4COOH$. The alcohol is then converted into the 1,1-dichloro-2,2,3,3,4,4,5,5,6,6,6-undecafluorohexane in the same manner as described above for the conversion of 2,2,3,3,3-pentafluoropropane into 1,1-dichloro-2,2,3,3,3-pentafluoropropane.

Additives such as rust inhibitors, surfactants, corrosion inhibitors, decomposition inhibitors, acid scavengers, antioxidants, and emulsifiers may be added to the solvents in order to obtain additional desired properties. For example, alcohols can be added which enable the solvents to be used to remove solder fluxes such as used on printed circuit boards.

The present method removes most contaminants from the surface of a substrate. For example, the present method removes organic contaminants such as mineral oils from the surface of a substrate. Under the term "mineral oils", both petroleum-based and petroleum-derived oils are included. Lubricants such as engine oil, machine oil, and cutting oil are examples of petroleum-derived oils.

The present method also removes water from the surface of a substrate. The method may be used in the single-stage or multi-stage drying of objects.

The present method cleans the surface of inorganic and organic substrates. Examples of inorganic substrates include metallic substrates, ceramic substrates, and glass substrates. Examples of organic substrates include polymeric substrates such as polycarbonate, polystyrene, and acrylonitrile-butadiene-styrene. The method also cleans the surface of natural fabrics such as cotton, silk, fur, suede, leather, linen, and wool. The method also cleans the surface of synthetic fabrics such as polyester, rayon, acrylics, nylon, and blends thereof, and blends of synthetic and natural fabrics. It should also be understood that composites of the foregoing materials may be cleaned by the present method. The present method is particularly useful in cleaning the surface of polycarbonate, polystyrene and ABS substrates.

The present method may be used in vapor degreasing, solvent cleaning, cold cleaning, dewatering, and dry cleaning. In these uses, the object to be cleaned is immersed in one or more stages in the liquid and/or vaporized solvent or is sprayed with the liquid solvent. Elevated temperatures, ultrasonic energy, and/or agitation may be used to intensify the cleaning effect.

HCFC-243CC may have enhanced stability with aluminum.

The present invention is more fully illustrated by the following non-limiting Examples.

All Examples were performed in small volume cylindrical containers (13×100 mm) for comparative purposes only. It should be understood that to maximize cleaning performance, the ratio of the volume of the solvent to the volume of the work piece to be cleaned should be maximized.

This may be accomplished by using a larger sump. Further improvements in cleaning performance may be accomplished by using commercial degreasing equipment and immersing the work piece in a boil sump, followed by a cold sump, and followed by a vapor rinse.

The term "severely attacked" as used in the results of the Examples means that the surface was deformed.

The term "cleaned off" as used in the results of the Examples means that no residue was discerned on the surface of the substrate based on a visual observation thereof.

The term "essentially removed" as used in the results of the Examples means that at least 95% of the contaminant was removed from the surface of the substrate.

EXAMPLES 1–3 AND COMPARATIVES 1–3

Comparatives 1–3 show that HCFC-123, HCFC-123a, and HCFC-141b attack polystyrene substrates upon cleaning light mineral oil from them while the present solvents do not.

The compounds used were as follows:

| Example | Compound |
|---|---|
| Comparative 1 | HCFC-123 |
| Comparative 2 | HCFC-123a |
| Comparative 3 | HCFC-141b |
| Example 1 | 1,1-dichloro-2,2,3,3,3,-pentafluoropropane |
| Example 2 | 1,3-dichloro-1,2,2,3,3,-pentafluoropropane |
| Example 3 | 1,1-dichloro-1,2,2,-trifluoropropane |

Commercially available HCFC-123, HCFC-123a, and HCFC-141b were used. The present solvents were prepared according to the aforementioned syntheses.

Strips of polystyrene which measured 0.125"×0.25"×2" (0.3175 cm×0.635 cm×5.08 cm) had coatings of light mineral oil thereon. The strips were submerged in each of the foregoing solvents at their boiling points for 10 minutes. Visual observations were made regarding changes in the appearance of the polystyrene strip. The results are reported in Table 1 below.

TABLE 1

| Example | Result |
|---|---|
| Comp. 1 | The polystyrene was severely attacked. |
| Comp. 2 | The polystyrene was severely attacked. |
| Comp. 3 | The polystyrene was severely attacked. |
| Ex. 1 | The light mineal oil was cleaned off the polystyrene strip. The solvent did not attack the polystyrene. |
| Ex. 2 | The light mineral oil was cleaned off the polystyrene strip. The solvent did not attack the polystyrene. |
| Ex. 3 | The light mineral oil was cleaned off the polystyrene strip. The solvent did not attack the polystyrene. |

These results indicate that HCFC-123, HCFC-123a, and HCFC-141b are unsuitable for cleaning polystyrene substrates because they attack the polymeric material. In contrast, the present solvents of Examples 1,2, and 3 are suitable for cleaning light mineral oil from polystyrene substrates and they do not attack the polymeric material.

EXAMPLES 4–6 AND COMPARATIVES 4–6

Comparatives 4–6 show that HCFC-123, HCFC-123a, and HCFC-141b attack polystyrene substrates upon cleaning 20W motor oil from them while the present solvents do not.

The compounds used were as follows:

| Example | Compound |
|---|---|
| Comparative 4 | HCFC-123 |
| Comparative 5 | HCFC-123a |
| Comparative 6 | HCFC-141b |
| Example 4 | HCFC-225CA |
| Example 5 | HCFC-225CB |
| Example 6 | HCFC-243CC |

Strips of polystyrene which measured 0.125"×0.25"×2" (0.3175 cm×0.635 cm×5.08 cm) had light coatings of 20W motor oil thereon. The strips were submerged in each of the foregoing solvents at the boiling points for 10 minutes. Visual observations were made regarding changes in the appearance of the polystyrene. The results are reported in Table 2 below.

TABLE 2

| Example | Result |
|---|---|
| Comp. 4 | The polystyrene was severely attacked. |
| Comp. 5 | The polystyrene was severely attacked. |
| Comp. 6 | The polystyrene was severely attacked. |
| Ex. 4 | The 20W motor oil was essentially removed from the polystyrene strip. The solvent did not attack the polystyrene. |
| Ex. 5 | The 20W motor oil was essentially removed from the polystyrene strip. The solvent did not attack the polystyrene. |
| Ex. 6 | The 20W motor oil was cleaned off the polystyrene strip. The solvent did not attack the polystyrene. |

These results also indicate that HCFC-123, HCFC-123a and HCFC-141b are unsuitable for cleaning polystyrene substrates because they attack the polymeric material. In contrast, the present solvents of Examples 4, 5 and 6 are suitable for cleaning 20W motor oil from polystyrene substrates and they do not attack the polymeric material.

EXAMPLES 7–9 AND COMPARATIVES 7–9

Comparatives 7–9 show that HCFC-123, HCFC-123a, and HCFC-141b attack polycarbonate substrates upon cleaning light mineral oil from them while the present solvents do not.

The compounds used were as follows:

| Example | Compound |
|---|---|
| Comparative 7 | HCFC-123 |
| Comparative 8 | HCFC-123a |
| Comparative 9 | HCFC-141b |
| Example 7 | 1,1-dichloro-2,2,3,3,3-pentafluoropropane |
| Example 8 | 1,3-dichloro-1,2,2,3,3-pentafluoropropane |
| Example 9 | 1,1-dichloro-1,2,2-trifluorpropane |

Strips of polycarbonate which measured 0.125"×0.25"×2" (0.3175 cm×0.635 cm×5.08 cm) had coatings of light mineral oil thereon. The strips were submerged in each of the foregoing solvents at their boiling points for 10 minutes. Visual observations were made regarding changes in the appearance of the polycarbonate. The results are listed in Table 3 below.

TABLE 3

| Example | Result |
|---|---|
| Comp. 7 | The polycarbonate surface turned cloudy. |
| Comp. 8 | The polycarbonate was attacked and the surface turned cloudy. |
| Comp. 9 | The polycarbonate turned cloudy with some streaking |
| Ex. 7 | The light mineral oil was essentially removed from the polycarbonate strip. The solvent did not attack the polycarbonate. |
| Ex. 8 | The light mineral oil was essentially removed from the polycarbonate strip. The solvent did not attack the polycarbonate. |
| Ex. 9 | The light mineral oil was essentially removed from the polycarbonate strip. The solvent did not attack the polycarbonate. |

These results indicate that HCFC-123, HCFC-123a, and HCFC-141b are unsuitable for cleaning polycarbonate substrates because they attack the polymeric material. In contrast, the present solvents of Examples 7, 8 and 9 are suitable for essentially removing light mineral oil from polycarbonate substrates and they do not attack the polymeric material.

EXAMPLES 10–12 AND COMPARATIVES 10–12

Comparatives 10–12 show that HCFC-123, HCFC-123a and HCFC-141b attack polycarbonate substrates upon cleaning 20W motor oil from them while the present solvents do not.

The compounds used were as follows:

| Example | Compound |
|---|---|
| Comparative 10 | HCFC-123 |
| Comparative 11 | HCFC-123a |
| Comparative 12 | HCFC-141b |
| Example 10 | HCFC-225CA |
| Example 11 | HCFC-225CB |
| Example 12 | HCFC-243CC |

Strips of polycarbonate which measured 0.125"×0.25"×2" (0.3175 cm×0.635 cm×5.08 cm) had coatings of 20W motor oil thereon. The strips were submerged in each of the foregoing solvents at their boiling points for 10 minutes. Visual observations were made regarding changes in the appearance of the polycarbonate. The results are reported in Table 4 below.

TABLE 4

| Example | Result |
|---|---|
| Comp. 10 | The polycarbonate surface turned cloudy. |
| Comp. 11 | The polycarbonate surface was attacked and turned cloudy. |
| Comp. 12 | The polycarbonate turned cloudy with some streaking. |
| Ex. 10 | The 20W motor oil was essentially removed from the polycarbonate strip. The solvent did not attack the polycarbonate. |
| Ex. 11 | The 20W motor oil was essentially removed from the polycarbonate strip. The solvent did not attack the polycarbonate. |
| Ex. 12 | The 20W motor oil was cleaned off the polycarbonate strip. The solvent did not attack the polycarbonate. |

These results indicate that HCFC-123, HCFC-123a, and HCFC-141b are unsuitable for cleaning polycarbonate substrates because they attack the polymeric material. In contrast, the present solvents of Examples 10, 11 and 12 are suitable for essentially removing 20W motor oil from polycarbonate substrates and they do not attack the polymeric material.

EXAMPLES 13–40

The present method described in Examples 1–3 is used to clean the following contaminants from the following substrates by using the listed solvents. Substantially the same results are obtained, that is to say, the contaminants are removed from the substrates without the substrates being attacked.

| Ex. | Solvent | Contaminant | Substrate |
|---|---|---|---|
| 13 | 1,3-dichloro-2,2-difluoropropane | engine oil | metal |
| 14 | 1,3-dichloro-1,2,2-trifluoropropane | machine oil | ceramic |
| 15 | 1,1-dichloro-2,2-difluoropropane | cutting oil | glass |
| 16 | 1,1-dichloro-2,2,3,3-tetrafluoropropane | water | glass |
| 17 | 1,4-dichloro-2,2,3,3-tetrafluorobutane | engine oil | cotton |
| 18 | 1,4-dichloro-1,2,2,3,3-pentafluorobutane | machine oil | wool |
| 19 | 1,4-dichloro-1,1,2,2,3,3-hexafluorobutane | cutting oil | metal |
| 20 | 1,4-dichloro-1,1,2,2,3,3,4-heptafluoro-butane | water | ceramic |
| 21 | 1,1-dichloro-2,2,3,3,-tetrafluorobutane | engine oil | glass |
| 22 | 1,1-dichloro-2,2,3,3,4-pentafluorobutane | machine oil | cotton |
| 23 | 1,1-dichloro-2,2,3,3,4,4-hexafluorobutane | cutting oil | wool |
| 24 | 1,1-dichloro-2,2,3,3,4,4,4,-heptafluoro-butane | water | metal |
| 25 | 1,5-dichloro-2,2,3,3,4,4-hexafluoropentane | engine oil | ceramic |
| 26 | 1,5-dichloro-1,2,2,3,3,4,4-heptafluoro-pentane | machine oil | glass |
| 27 | 1,5-dichloro-1,1,2,2,3,3,4,4-octafluoro-pentane | cutting oil | cotton |
| 28 | 1,5-dichloro-1,1,2,2,3,3,4,4,5-nonafluoro-pentane | cutting oil | wool |
| 29 | 1,1-dichloro-2,2,3,3,4,4,-hexafluoropentane | engine oil | wool |
| 30 | 1,1-dichloro-2,2,3,3,4,4,5-heptafluoro-pentane | machine oil | metal |
| 31 | 1,1-dichloro-2,2,3,3,4,4,5,5-octafluoro-pentane | cutting oil | ceramic |
| 32 | 1,1-dichloro-2,2,3,3,4,4,5,5,5-nonafluoro-pentane | engine oil | metal |
| 33 | 1,6-dichloro-2,2,3,3,4,4,5,5-octafluoro-hexane | machine oil | ceramic |
| 34 | 1,6-dichloro-1,2,2,3,3,4,4,5,5-hexafluoro-hexane | cutting oil | glass |
| 35 | 1,6-dichloro-1,2,2,3,3,4,4,5,5,6-deca-fluorohexane | water | glass |
| 36 | 1,6-dichloro-1,1,2,2,3,3,4,4,5,5,6-undeca-fluorohexane | engine oil | cotton |
| 37 | 1,1-dichloro-2,2,3,3,4,4,5,5-octafluoro-hexane | machine oil | wool |
| 38 | 1,1-dichloro-1,2,2,3,3,4,4,5,5-nonafluoro-hexane | cutting oil | metal |
| 39 | 1,1-dichloro-1,2,2,3,3,4,4,5,5,6-deca-fluorohexane | water | ceramic |
| 40 | 1,1,-dichloro-1,2,2,3,3,4,4,5,5,6,6-undeca-fluorohexane | engine oil | glass |

EXAMPLES 41–43 AND COMPARATIVES 41–43

Comparatives 41–43 show that HCFC-123, HCFC-123a and HCFC-141b attack ABS substrates upon cleaning light mineral oil from them while the present solvents do not.

The compounds used were as follows:

| Example | Compound |
|---|---|
| Comparative 41 | HCFC-123 |
| Comparative 42 | HCFC-123a |
| Comparative 43 | HCFC-141b |
| Example 41 | HCFC-225CA |
| Example 42 | HCFC-225CB |
| Example 43 | HCFC-243CC |

Strips of acrylonitrile-butadiene-styrene which measured 0.125"×0.25"×2" (0.3175 cm×0.635 cm×5.08 cm) had coatings of light mineral oil thereon. The strips were submerged in each of the foregoing solvents at their boiling points for 10 minutes. One side of the ABS used was smooth while the other side was stippled. Visual observations were made regarding changes in the appearance of the ABS. The results are reported in Table 5 below.

TABLE 5

| Example | Result |
|---|---|
| Comp. 41 | The solvent severely attacked the ABS. |
| Comp. 42 | The solvent severely attacked the ABS. |
| Comp. 43 | The solvent removed most of the stippling. |
| Ex. 41 | The light mineral oil was essentially removed from the ABS strip. The solvent did not attack the ABS. |
| Ex. 42 | The light mineral oil was essentially removed from the ABS strip. The solvent did not attack the ABS. |
| Ex. 43 | The light mineral oil was essentially removed from the ABS strip. The solvent did not attack the ABS. |

These results indicate that HCFC-123, HCFC-123a, and HCFC-141b are unsuitable for cleaning ABS substrates because they attack the polymeric material. In contrast, the present solvents of Examples 41, 42, and 43 are suitable for essentially removing light mineral oil from ABS and they do not attack the polymeric material.

EXAMPLES 44–46 AND COMPARATIVES 44–46

Comparatives 44–46 show that HCFC-123, HCFC-123a, and HCFC-141b attack ABS substrates upon cleaning 20W motor oil from them while the present solvents do not.

The compounds used were as follows.

| Example | Compound |
|---|---|
| Comp. 44 | HCFC-123 |
| Comp. 45 | HCFC-123a |
| Comp. 46 | HCFC-141b |
| Ex. 44 | HCFC-225CA |
| Ex. 45 | HCFC-225CB |
| Ex. 46 | HCFC-243CC |

Strips of acrylonitrile-butadiene-styrene which measured 0.125"×0.25"×2" (0.3175 cm×0.635 cm×5.08 cm) had coatings of 20W motor oil thereon. The strips were submerged in each of the foregoing solvents at their boiling points for 10 minutes. One side of the ABS used was smooth while the other side was stippled. Visual observations were made regarding changes in the appearance of the ABS. The results are report in Table 6 below.

TABLE 6

| Example | Result |
|---|---|
| Comp. 44 | The solvent severely attacked the ABS. |
| Comp. 45 | The solvent severely attacked the ABS. |
| Comp. 46 | The solvent removed most of the stippling |
| Ex. 44 | The 20W motor oil was essentially removed from the ABS strip. The solvent did not attack the ABS. |
| Ex. 45 | The 20W motor oil was cleaned from the ABS strip. The solvent did not attack the ABS. |
| Ex. 46 | The 20W motor oil was essentially removed from the ABS strip. The solvent did not attack the ABS. |

These results indicate that HCFC-123, HCFC-123a, and HCFC-141b are unsuitable for cleaning ABS substrates because they attack the polymeric material. In contrast, the present solvents of Examples 44, 45, and 46 are suitable for essentially removing 20W motor oil from ABS and they do not attack the polymeric material.

Having described the invention in detail and by reference to preferred embodiments thereof, it will be apparent that modifications and variations are possible without departing from the scope of the invention defined in the appended claims.

What is claimed is:

1. A method of cleaning a surface of a substrate which comprises treating said surface with a solvent comprising a compound of the formula $$CH_aCl_bF_c(CF_2)_dCH_eCl_fF_g$$

wherein a+e ranges from 1 to 4, b+f equals 2, c+g ranges from 0 to 3, d is from 1 to 4, a+b+c=3, and e+f+g=3, said solvent being a solvent for contaminants on said surface and said treatment removing said contaminants from said surface.

2. The method of claim 1 wherein said method removes organic contaminants from said surface.

3. The method of claim 1 wherein said method removes water from said surface.

4. The method of claim 1 wherein said method cleans the surface of an inorganic substrate.

5. The method of claim 1 wherein said method cleans the surface of a metallic substrate.

6. The method of claim 1 wherein said method cleans the surface of a ceramic substrate.

7. The method of claim 1 wherein said method cleans the surface of a glass substrate.

8. The method of claim 1 wherein said method cleans the surface of an organic substrate.

9. The method of claim 1 wherein said method cleans the surface of a polymeric substrate.

10. The method of claim 1 wherein said method cleans the surface of a polycarbonate substrate.

11. The method of claim 1 wherein said method cleans the surface of a polystyrene substrate.

12. The method of claim 1 wherein said method cleans the surface of a natural fabric or synthetic fabric selected from the group consisting of cotton, wool, silk, fur, suede, leather, linen, polyester, rayon, acrylic, nylon, and blends thereof.

13. The method of claim 1 wherein said d is 1 to 3.

14. The method of claim 1 wherein said solvent is 1,1-dichloro-2,2,3,3,3-pentafluoropropane.

15. The method of claim 1 wherein said solvent is 1,3-dichloro-1,1,2,2,3-pentafluoropropane.

16. The method of claim 13 wherein said c+g ranges from 0 to 2.

17. The method of claim 1 wherein said solvent is 1,1-dichloro-1,2,2-trifluoropropane.

18. The method of claim 1 wherein said method cleans the surface of an acrylonitrile-butadiene-styrene substrate.

19. The method of claim 1 wherein d is 1 to 2.

20. The method of claim 1 wherein said method cleans the surface of a polymeric substrate selected from the group consisting of polycarbonate, polystyrene, and acrylonitrile-butadiene-styrene with a solvent selected from the group consisting of 1,1-dichloro-2,2,3,3,3-pentafluoropropane; 1,3-dichloro-1,1,2,2,3-pentafluoropropane; and 1,1-dichloro-1,2,2-trifluoropropane.

21. The method of claim 1 wherein said method removes mineral oil from said surface.

* * * * *